United States Patent [19]

Ezawa

[11] 4,442,751

[45] Apr. 17, 1984

[54] EFFECT GENERATING SYSTEM FOR AN ELECTRONIC MUSICAL INSTRUMENT

[75] Inventor: Sadaaki Ezawa, Shizuoka, Japan

[73] Assignee: Kabushiki Kaisha Kawai Gakki Seisakusho, Japan

[21] Appl. No.: 392,899

[22] Filed: Jun. 28, 1982

[30] Foreign Application Priority Data

Jul. 2, 1981 [JP] Japan ..... 56-103684

[51] Int. Cl.[3] ..... G10H 1/04

[52] U.S. Cl. ..... 84/1.25; 84/1.24

[58] Field of Search ..... 84/1.25, 1.01, 1.24, 84/1.03

[56] References Cited

U.S. PATENT DOCUMENTS 4,351,220 9/1982 Yamada et al. ..... 84/1.25

*Primary Examiner*—Forester W. Isen

*Attorney, Agent, or Firm*—McGlew and Tuttle

[57] ABSTRACT

In an electronic musical instrument which is equipped with the function of producing both glide and vibrato effects, a circuit is provided so that when the glide effect starts to restore to its ordinary pitch, delayed vibrato is started, thereby eliminating an effect during the switchover from the glide effect to the vibrato effect.

1 Claim, 4 Drawing Figures

EFFECT GENERATING SYSTEM FOR AN ELECTRONIC MUSICAL INSTRUMENT

BACKGROUND OF THE INVENTION

1. Field of the Invention

The present invention relates to an effect generating system for an electronic musical instrument which provides both vibrato and glide effects. The effects are added, one at a time, to musical tones being generated. More particularly the inventive effect generating system eliminates an unnatural effect from the generated musical tones which is caused by a discontinuity in operation between glide and vibrato performances at the time of switchover from the former to the latter.

2. Description of the Prior Art

In conventional electronic musical instruments equipped with function of producing the vibrato and glide effects, in the case of generating these effects, when both vibrato modulation data indicated by 1 in FIG. 1(*a*) and glide modulation data indicated by 2 in FIG. 1(*a*) are simultaneously provided, frequency is carried out by a signal obtained by adding them as shown in FIG. 1(*b*), or the glide effect is introduced interrupting the vibrato effect as shown in FIG. 1(*c*). In the electronic musical instrument which can not provide both effects at the same time, such a signal as shown in FIG. 1(*c*) is obtained. The former method calls for the provision of means for adding together the vibrato modulation data and the glide modulation data but no particular effect is obtained. The latter method presents a problem in that it creates a feeling of unnaturalness in switching over the glide effect to the vibrato effect. That is to say, in the case of the latter method, when changed over from the glide performance, the vibrato performance that has been interrupted for providing the glide effect is suddenly started, giving the listener an abrupt and unnatural impression.

SUMMARY OF THE INVENTION

It is therefore an object of the present invention to eliminate this unnatural effect when switching between the glide effect and the vibrato effect.

Briefly stated, according to the present invention, in an electronic musical instrument which is equipped with the function of producing both the glide and the vibrato effect, means are provided for starting delayed vibrato when the glide effect begins to restore to its ordinary pitch, whereby to ensure a smooth changeover from the glide effect to the vibrato effect.

DESCRIPTION OF THE PREFERRED EMBODIMENTS

Figure 1:
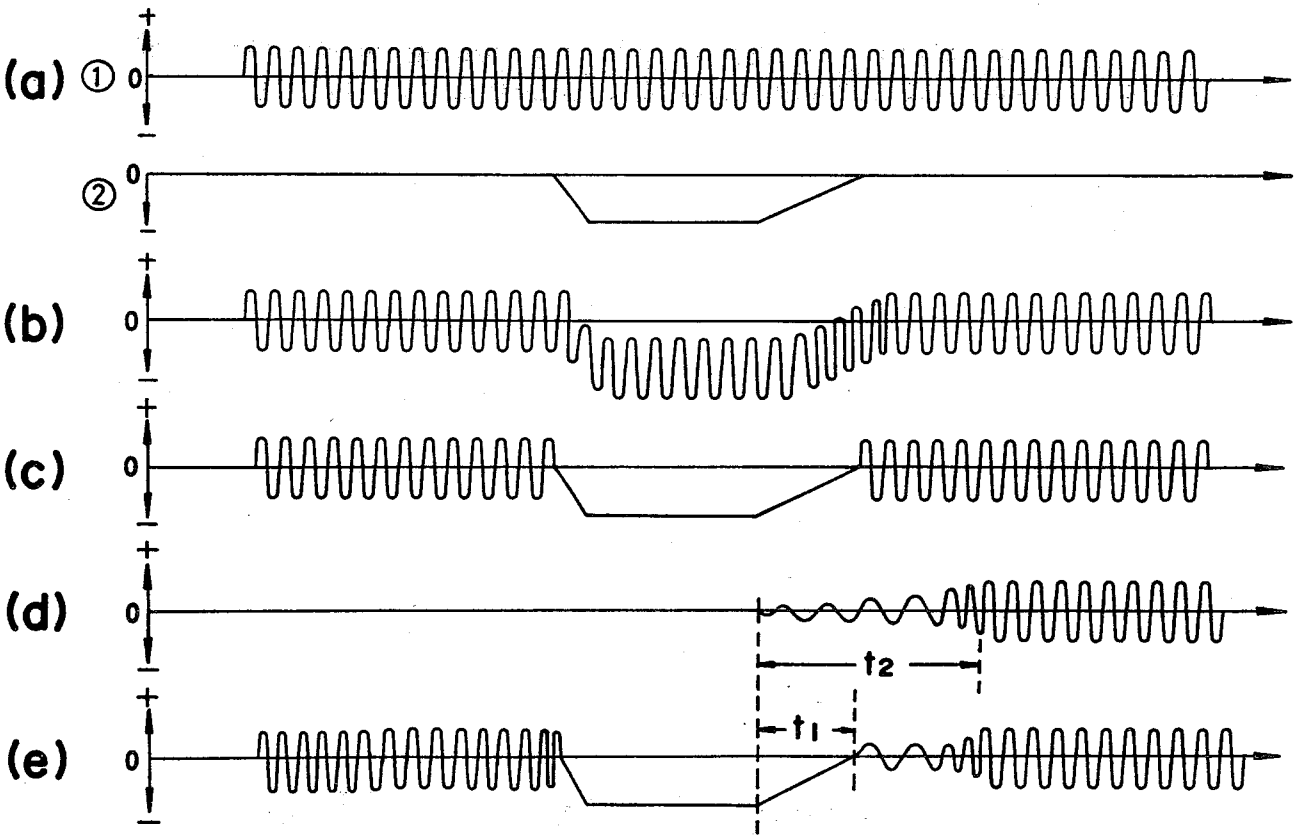
FIG. 1 shows waveform diagrams explanatory of a prior art example and the present invention.

FIG. 1(*e*) is a waveform diagram explanatory of the operation of the present invention in comparison with the operation of the prior art example shown in FIGS. 1(*b*) and (*c*).

When the glide performance is started by turning ON a glide switch, it is necessary only to interrupt the vibrato performance as in the case of FIG. 1(*c*) but, when the glide switch is turned OFF, a delay vibrato is started at the moment when the glide effect begins to return to its ordinary pitch as shown in FIG. 1(*d*) and, at the moment when the glide performance comes to an end (in the latter half of the delay vibrato), the vibrato performance is commenced, thereby ensuring a smooth changeover from the glide to the vibrato performance.

In general, the time ($t_1$) from the moment the glide effect starts to restore to the ordinary pitch to the moment the restoration complete is shorter than the time ($t_2$) in which the delayed vibrato grows. The abovesaid processing by the present invention creates such a feeling of naturalness as if the delayed vibrato is started from the moment when the glide effect begins to restore to the ordinary pitch. This agrees with the execution in which the vibrato gradually grows after the glide or portamento in the case of playing a trombone, violin or like musical instrument. The system of the present invention utilizes the delayed vibrato effect widely adopted in electronic musical instruments, and hence does not necessitate the provision of a special circuit therefor and, acccordingly, it is inexpensive.

Figure 2:
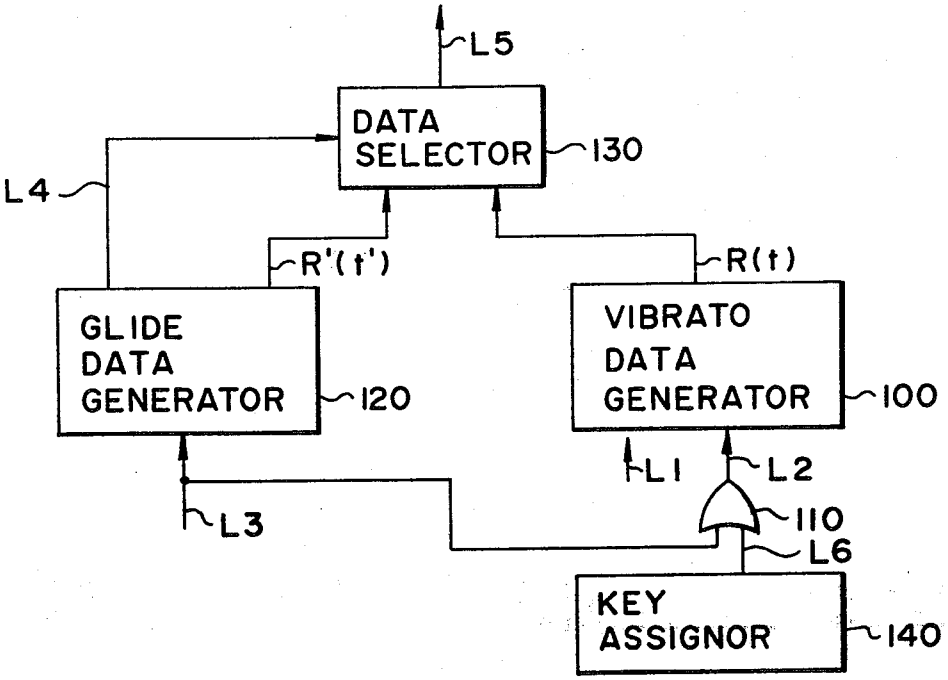
FIG. 2 is a block diagram illustrating an embodiment of the present invention.
Figure 3:
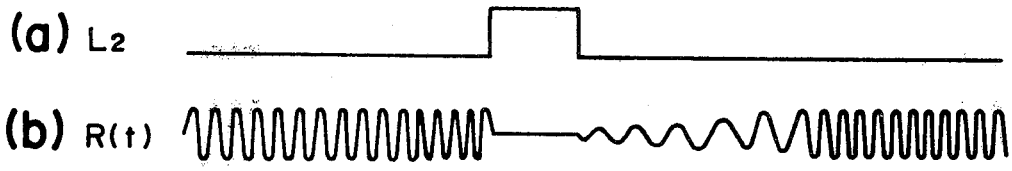
FIG. 3 and FIG. 4 are waveform diagrams explanatory of the operation of the principal part of the embodiment shown in FIG. 2.
Figure 4:
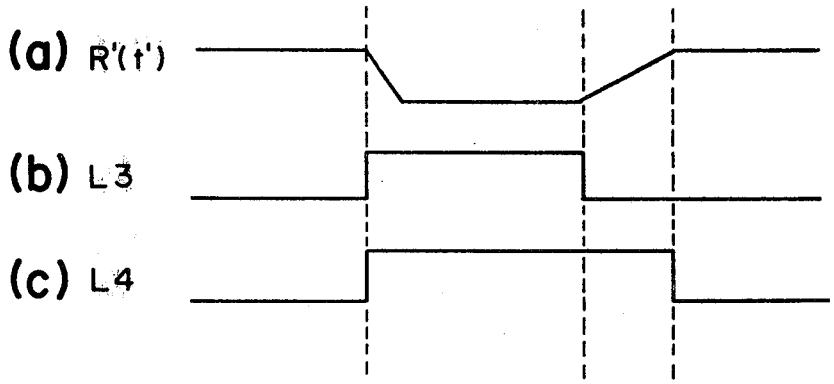

FIG. 2 is a block diagram illustrating the arrangement of an embodiment of the present invention. At the output of a vibrato data generator 100 are yield vibrato modulation data R(*t*) based on vibrato switch information inputted from a line L1. The delayed vibrato is started by a positive pulse signal that is provided on a line L2 from an OR circuit 110. In this case, the input to the vibrato data generator 100 from the line L2 and the vibrato modulation data R(*t*) bear such relationship as shown in FIGS. 3(*a*) and (*b*). When a vibrato effect is ON, the vibrato modulation data assume such a waveform as shown in FIG. 1(*a*) 1 but when the positive pulse signal of FIG. 3(*a*) is applied from the line L2 to the vibrato data generator 100, the vibrator modulation data R(*t*) assumes such a waveform as shown in FIG. 3(*b*). Since the vibrato data generator 100 is well-known (see U.S. Pat. Nos. 3,929,053, 3,951,030, 3,965,789 and 3,979,996) no detailed description will be given. At the output of a glide data generator 120, glide modulation data R′(*t*′) is generated which is based on glide switch information applied thereto from an input line L3. The output provided on a line L4 from the glide data generator 120 is a signal indicating the period in which the glide effect is being produced. The output on the line L4 acts to select a data of data selector 130 which functions to interrupt the vibrato performance by the glide performance. In this case, the glide modulation data R′(*t*′) from the glide data generator 120, the input thereto from the line L3 and the output therefrom to the line L4 bear such relationships as shown in FIGS. 4(*a*) to (*c*). The data selector 130 delivers R(*t*) or R′(*t*′) on a line 15 depending upon whether the output on the line L4 is "0" or "1".

By inputting a key depression signal (a positive pulse signal generated by a key depression) which is provided on a line L6 from a key assignor 140 and the signal on the line L3 into the OR gate 110, when the signal on the line L3 is "0" (when the glide switch is OFF), an ordinary delay vibrato can be started by the key depression signal on the line L6. Where the signal on the line L3 is "1" (when the glide switch is ON), the delay vibrato is started when the signal on the line L3 changes from "1" to "0", that is, when the glide effect begins to return to the ordinary pitch upon turning OFF of the glide switch. Accordingly, after completion of the glide performance, the moment at which the data selector 130 again selects the vibrato data from the glide data is in the latter half period of the delay vibrato performance.

Accordingly, the present invention can be achieved by producing the modulation effect based on the frequency modulation data which are provided on the line L5. If the outputs $R(t)$ and $R'(t')$ are analog signals, then the data selector 130 is also used in analog form. And the oscillation frequency of a master oscillator of a top octave synthesizer is voltage-controlled by the output on the line L5.

If the frequency modulation data outputs $R(t)$ and $R'(t')$ are digital signals, then the data selector 130 is also used in digital form.

As has been described in the foregoing, according to the present invention, while the glide effect is produced, the vibrato effect is stopped and, from the moment of termination of the glide effect, the delayed vibrato effect started prior thereto is restored with a feeling of naturalness. Thus, it is possible to completely eliminate unnaturalness in the switchover from the glide effect to the vibrato effect.

It will be apparent that many modifications and variations may be effected without departing from the scope of the novel concepts of the present invention.

What is claimed is:

1. In combination an effect generating system for producing a glide effect and vibrato effect and an electronic musical instrument having a keyboard, said effect generating system comprising:

a glide data generator for generating glide data with glide switch information indicating that a glide effect is being restored to an original pitch;

a vibrato data generator for generating vibrato data which comprise a delay vibrato effect in response to a key depression signal;

a data selector for selecting glide data from the glide data generator during performance of a glide effect and for selecting vibrato data from the vibrato data generator during performance of a vibrato effect except during performance of the glide effect; and means for starting the delay vibrato effect upon the occurrence of either of said glide switch information during the performance of a glide effect or the occurence of a key depression signal when a glide effect is not being performed.

* * * * *